United States Patent [19]

Bennett

[11] Patent Number: 4,789,070

[45] Date of Patent: Dec. 6, 1988

[54] CLOTHES AIRER

[76] Inventor: Richard Bennett, 36 Wallala Avenue, Park Holme 5043, Australia

[21] Appl. No.: 59,960

[22] Filed: Jun. 6, 1987

[51] Int. Cl.[4] ..... A47F 43/00

[52] U.S. Cl. ..... 211/200; 24/115 G; 312/184

[58] Field of Search ..... 211/200, 175, 11, 45, 211/46, 119.09, 119.15; 312/184; 24/115 G

[56] References Cited

U.S. PATENT DOCUMENTS

| | | | |
|---|---|---|---|
| 146,087 | 12/1873 | Miller | 211/200 |
| 1,379,093 | 5/1921 | Freeberg | 24/115 G |
| 1,388,045 | 8/1921 | Johnson | 24/115 G |
| 1,685,925 | 10/1928 | Linch et al. | 211/200 |
| 2,415,784 | 2/1947 | Block | 211/200 |
| 2,706,829 | 4/1955 | Charnin | 211/200 X |
| 3,208,456 | 9/1965 | Peebles | 312/184 |
| 3,298,537 | 1/1967 | Di Marco | 211/200 |
| 3,788,718 | 1/1974 | Bjorn et al. | 312/184 |

OTHER PUBLICATIONS

Australian Specification, Drying Rack, Author—Throughton, L. H., 08/14/81, No. 74309/81 (now lapsed).

*Primary Examiner*—Ramon O. Ramirez
*Assistant Examiner*—Sarah A. Lechok Eley
*Attorney, Agent, or Firm*—Baker, Maxham & Jester

[57] ABSTRACT

Clothes airer of the type having a pair of hinged frames each with a pair of legs joined by a beam, the legs being pivoted between their upper and lower ends so that the frames can fold or unfold between retracted and in-use positions, there being struts spaced from one another along each beam which will receive clothes pegs for carrying clothes requiring airing or drying when stretched between the beams, and a retracting line with a releasable line lock joining the beams and being adjustable for length so as to adjust the distance between the beams.

6 Claims, 3 Drawing Sheets

21
22
23
24
25
27
28
32
34
36
37
38
39
40
41
43

CLOTHES AIRER

BACKGROUND OF THE INVENTION

This invention relates to a device for the airing of clothes, of the type wherein the clothes can be retained by pegs carried by pins or struts on beams on a foldable frame.

It is known that clothes airers of this type have been proposed heretofore, but they have been subject to a number of difficulties of which it is the object of this invention to overcome.

The closest prior art known to the Applicant is the (now lapsed) Australian specification No. 74309/81 in the name of TROUGHTON, to which the reader is referred.

The main difficulty encountered previously has been that the frame members unfold to an in-use position wherein the beams are spaced at a distance which is not adjustable, or alternatively at a distance determined by the "hanging length" of the shortest garment to be aired or dried, and thereby is not adaptable for many uses.

SUMMARY OF THE INVENTION

Briefly in this invention a clothes airer comprises a pair of frames, each frame comprising a pair of legs and a beam joining the upper ends of the legs, pivots between leg upper and lower ends joining the legs of one frame to corresponding legs of the other frame so that the frames can fold or unfold between a retracted position wherein the beams are close to one another, and an in-use position wherein the beams are further apart, a plurality of struts spaced from one another along each said beam, and a retracting line with a releasable line lock thereon joining the beams and being operable to adjust the distance between the beams upon said folding or unfolding of said frames.

BRIEF DESCRIPTION OF THE DRAWINGS

It will be clear that the invention can be effected in a number of different ways, and embodiments are described hereunder in some detail with reference to and are illustrated in the accompanying drawings in which.

DETAILED DESCRIPTION OF PREFERRED EMBODIMENS

Figure 1:
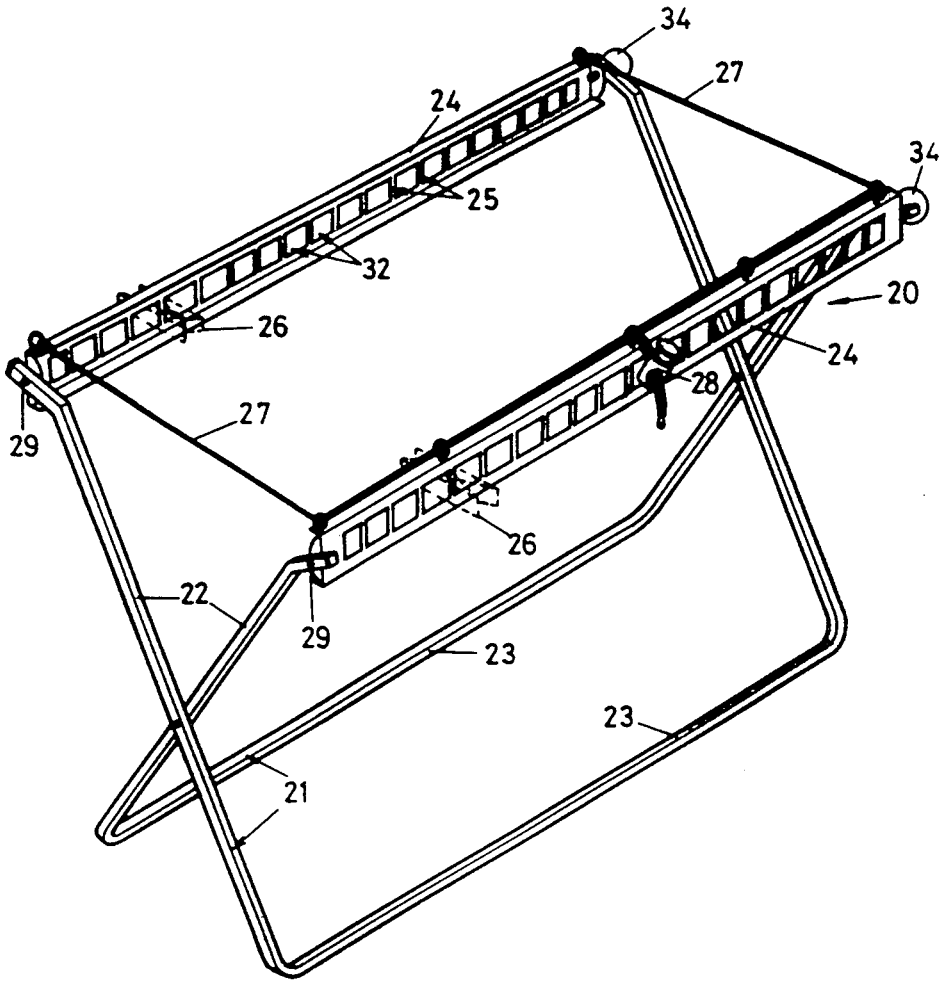
FIG. 1 is a perspective view of a clothes airer according to a first embodiment.

Referring first to FIGS. 1, 2, 3 and 4 a clothes airer 20 comprises two U-frames 21, the legs 22 of which are of rectangular section tube directed upwardly from the bridges 23 which are arranged to be supported from the ground or floor. The upper ends of the legs 22 are bent outwardly and upwardly as shown, and carry on them the ends of respective channel-section beams 24 the webs of which contain apertures 32 spaced apart by a plurality of struts 25 which function as pins and receive clothes pegs 26. The clothes pegs 26 retain the clothes which require airing in a parallel array. For simplicity of drawing, only eleven struts 25 in each beam are illustrated, but more commonly an airer would have a much larger number, (for example thirty.)

Figure 3:
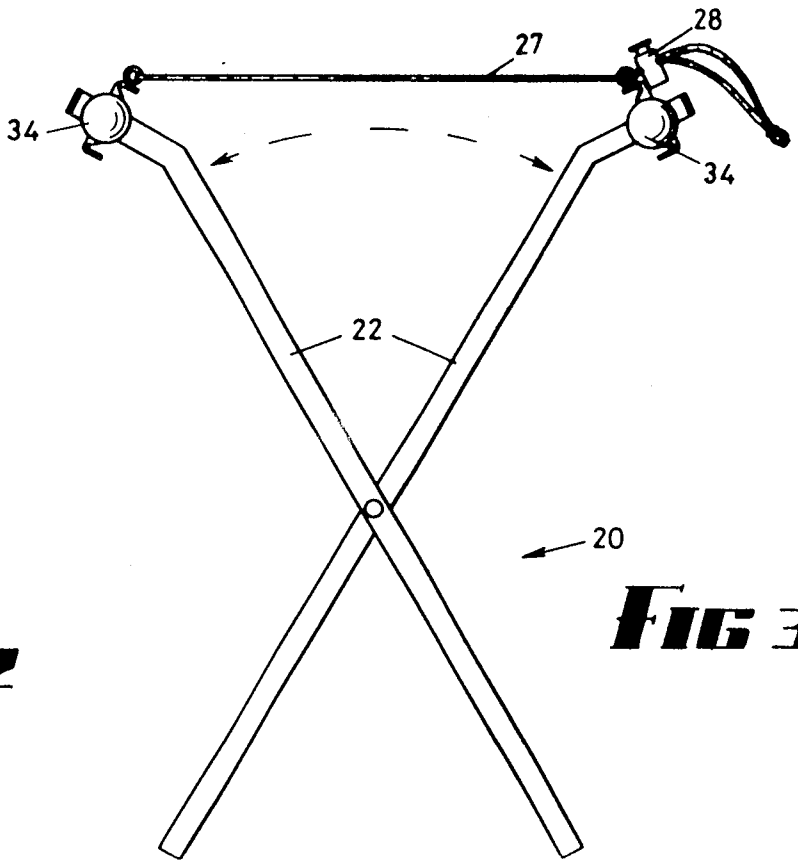
FIG. 3 is an end elevation of FIG. 1 when unfolded to its in-use position.
Figure 2:
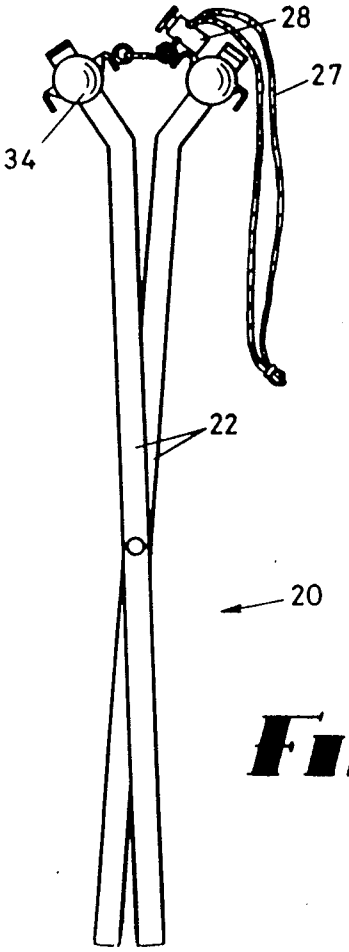
FIG. 2 is an end elevation of FIG. 1 when folded to its retracted position.

The extent of opening of the legs to the unfolded position illustrated in FIGS. 1 and 3 is restrained by a retracting line 27 which passes through loops on one of the beams 24 as shown, and which can be retained in selected positions by a line lock 28. Each beam 24 is rotatable about a stem 39 of a respective handle 34 at one end, and a pivot pin 29 at the other. This is of great importance to physically handicapped people.

It will immediately be apparent that the construction shown is very inexpensive, and the device is easily used and effective for airing of clothes.

Figures 4, 5, 6:
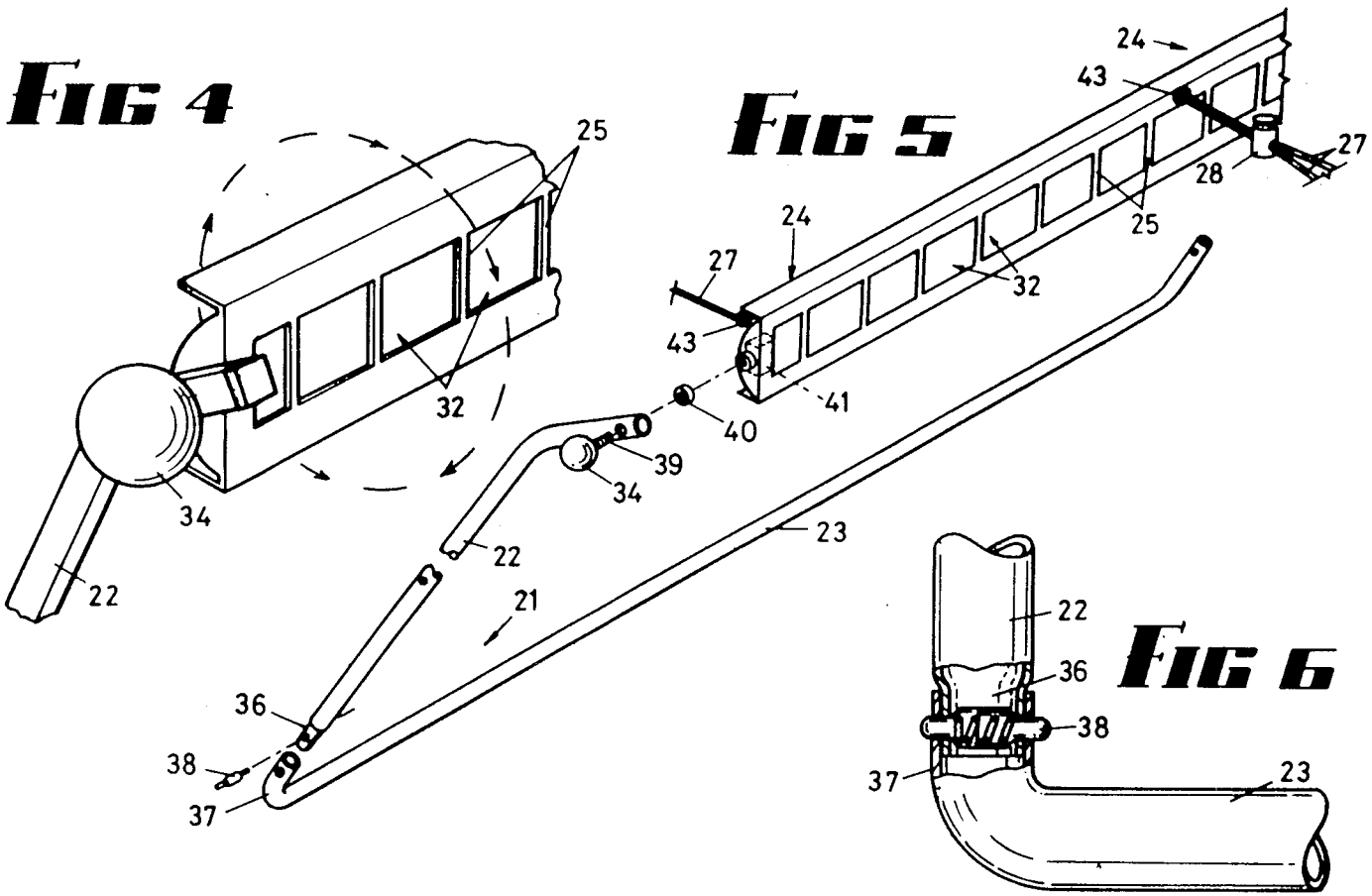
FIG. 4 is a fragmentary perspective view illustrating the manner in which a beam can be rotated.
FIG. 5 is a fragmentary perspective "exploded" view of a second embodiment.
FIG. 6 is a fragmentary partly sectioned view drawn to a scale larger than that of FIG. 5.

In the second embodiment of FIGS. 5 and 6, similar elements bear similar designations, and the beams 24 are similarly formed from punched metal, containing a plurality of apertures 32 between which are located the struts 25. Each beam is arranged to be rotated as required about the axis of a respective handle 34 and this facility is particularly useful for retaining the beams 24 closely adjacent when the airer is folded to its retracted position.

Legs 22 in the second embodiment are of circular section tube, and each 'U' frame 21 is in three portions for reduction of packaging space. The lower ends of legs 22 are swaged inwardly at 36, the swaged portions 36 entering upturned ends 37 of bridges 23, and retained in spigot-and-socket connections by spring retainers 38.

The threaded stem 39 of each handle 34 passes through a nylon washer 40 to threadably engage a metal block 41 at the end of beam 24, so as to releasably clamp the beam 24 to its frame 21.

In FIG. 5, the line 27 does not pass through loops as in the first embodiment, but is guided by guide rings 43 to be partly contained within the channel portion of one of the beams 24.

In some instances it is desired to utilise rods instead of sheet metal as struts, and in a further embodiment not illustrated, the beam is provided with upper and lower chords each of narrow mouth channel shape, and a series of spacers space apart a series of wire struts. In a still further alternative, use can be made of moulded plastic blocks which are contained within the channels of the chords, and which retain the struts which are formed from a continuous length of wire as shown.

Thus it will be seen that the beams (the most expensive parts of the airer) can be formed from punched plate, can be of flexible cord or wire, can be constituted by straight pins, or by a wire "ladder".

I claim:

1. A clothes airer comprising a pair of frames, each frame comprising a pair of legs, a bridge, and a beam joining the upper ends of the legs, pivots between leg upper and lower ends joining the legs of one frame to corresponding legs of the other frame so that the frames can fold or unfold between a retracted position wherein the beams are close to one another, and an in-use position wherein the beams are further apart, a plurality of struts spaced from one another along each said beam, said struts being of such size, shape and spacing as to receive clothes pegs for carrying clothes when stretched between the beams, a respective handle at one end of each beam, each said handle having a threaded stem which extends through a frame leg and threadably engages means on that said beam, said beam being selectably rotatable about said stem, but wherein said handle is rotatable with respect to said beam to clamp its said beam to a relevant said frame leg, and a retracting line with a releasable line lock thereon joining the beams and being operable to adjust the distance between the beams upon said folding or unfolding of said frames.

2. A clothes airer according to claim 1 wherein each said beam comprises a channel having a web and a pair of flanges, said web containing a plurality of apertures separated by said struts.

3. A clothes airer according to claim 1 comprising guide means on each said beam, said line extending through said guide means and said line lock, and terminating beyond said line lock.

4. A clothes airer according to claim 1 wherein said threadably engaged means comprises a respective block in one end of each said beam containing a threaded aperture which is threadably engaged by a respective said threaded stem.

5. A clothes airer according to claim 1 wherein the legs and bridge portion of each said frame are three separate portions, and further comprising spring retainers retaining those portions together in spigot-and-socket connections.

6. A clothes airer for supporting a plurality of articles of clothing comprising:

a pair of generally U-shaped frames, each frame comprising a pair of legs having upper and lower ends and connected by a bridge at the lower ends, pivot means between the upper and lower ends of the legs for joining the legs of one frame to corresponding legs of the other frame so that the frames can fold and unfold between a retracted position wherein the beams are close to one another, and an in-use position wherein the beams are positioned apart, an elongated beam selectively rotatably mounted between the upper ends of the legs of each frame, said beam including a plurality of struts spaced from one another along said beam, said struts being of such size, shape and spacing as to receive clothes pegs for carrying clothes when stretched between the beams, a respective handle at one end of each beam, each said handle having a threaded stem which extends through a frame leg and threadably engages threaded means on that said beam, said beam being selectably rotatable about said stem, but wherein each said handle is rotatable with respect to its said beam to clamp said beam to a relevant said frame leg, and a retracting line with a releasable line lock thereon joining the beams and being operable to adjust the distance between the beams upon said unfolding of said frames.

* * * * *